US005431756A

United States Patent [19]

Kosowski et al.

[11] Patent Number: 5,431,756

[45] Date of Patent: Jul. 11, 1995

[54] METHOD AND COMPOSITION FOR MELT CAST EXPLOSIVES, PROPELLANTS AND PYROTECHNICS

[75] Inventors: Bernard M. Kosowski; Robert C. Taylor, both of King of Prussia, Pa.

[73] Assignee: Mach I, Inc., King of Prussia, Pa.

[21] Appl. No.: 22,327

[22] Filed: Feb. 25, 1993

[51] Int. Cl.[6] ..... C06B 45/06; C06B 21/00

[52] U.S. Cl. ..... 149/18; 149/19.1; 149/38; 149/44; 149/105; 264/3.1

[58] Field of Search ..... 149/18, 38, 44, 19.1, 149/105; 264/3.1

[56] References Cited

U.S. PATENT DOCUMENTS

| | | | |
|---|---|---|---|
| 990,585 | 4/1911 | Palmer | 149/44 |
| 1,032,242 | 7/1912 | Rickmers | 149/44 |
| 3,344,004 | 9/1967 | Desmarais | 149/20 |
| 3,440,014 | 5/1969 | Chrisp | 149/45 |
| 3,472,713 | 10/1969 | Berthmann et al. | 149/92 |
| 3,620,857 | 11/1971 | Soderberg et al. | 149/18 |
| 3,622,408 | 11/1971 | Lyerty | 149/109 |
| 4,000,021 | 12/1976 | Voigt, Jr. | 149/17 |
| 4,149,916 | 4/1979 | Wade | 149/55 |
| 4,284,442 | 8/1981 | Voigt, Jr. et al. | 149/18 X |
| 4,300,001 | 11/1981 | Hendrickx | 568/767 |
| 4,310,364 | 1/1982 | Ekman et al. | 149/2 |
| 4,348,242 | 9/1982 | O'Dette et al. | 149/7 |
| 4,722,757 | 2/1988 | Cooper et al. | 149/2 |
| 4,747,892 | 5/1988 | Spencer | 149/20 |
| 5,007,973 | 4/1991 | Trapp et al. | 149/109.6 |
| 5,358,587 | 10/1994 | Voigt, Jr. et al. | 149/18 |

*Primary Examiner*—Peter A. Nelson
*Attorney, Agent, or Firm*—William C. Long

[57] ABSTRACT

The invention relates to melt cast explosives, propellants or pyrotechnics which contain a nitrated energetic material such as trinitrotoluene, a desensitizer such as wax or petroleum oil and an alkylated polyvinylpyrrolidone emulsifying agent.

11 Claims, No Drawings

METHOD AND COMPOSITION FOR MELT CAST EXPLOSIVES, PROPELLANTS AND PYROTECHNICS

BACKGROUND OF THE INVENTION

1. Field of the Invention

The present invention relates to melt cast explosives, propellants and pyrotechnics and especially to the formation of stable emulsions of nitrated energetic materials such as trinitrotoluene and desensitizers such as wax or polymeric materials and the melt casting of the emulsions.

2. Description of the Prior Art

Trinitrotoluene is the most widely used explosive and pyrotechnic in the military and the industrial market. Other much more energetic and dangerous explosive materials are sometimes used separately and often are dispersed into molten trinitrotoluene before casting, or admixed as solid particles. A problem with such materials has been the shock and/or thermal sensitivity of the materials which sometimes resulted in premature detonations.

Many years ago, it was discovered that natural wax such as beeswax, carnauba wax, Ozokerite and Montan wax could be used to desensitize these explosives. In the period of 1940–1960, it was found that petroleum wax and many other chemicals having similar wax-like physical properties such as stearic acid and its sodium, calcium and barium salts, cetyl alcohol, low molecular weight polyethylene wax, polyethoxyethanediol and its monoesters such as stearate, could also be used to desensitize these explosives. Because of its low cost and good desensitizing characteristics, fully refined paraffin wax and microcrystalline wax from petroleum became the most widely used desensitizers. The most widely used U.S. government specification for such wax is MIL-W-20553D, Wax, Desensitizing, originally issued in 1962.

The process used most widely to formulate the explosives and pyrotechnics is the trinitrotoluene melt cast system. Trinitrotoluene is melted by heating in a steam jacketed stirred kettle to 87°–95° C., about 1 to 10 weight percent of the desensitizing wax is added and stirred vigorously to emulsify the wax into the molten trinitrotoluene. The melt is then cast into the munitions case and cooled to solidify. The emulsifiers for incorporating the wax into the molten trinitrotoluene are dispersed in the wax purchased for this application as specified by MIL-C-18164A(OS), 1968 Composition D-2. The emulsifiers are 14 weight percent nitrocellulose, 2 weight percent lecithin in 84 weight percent MIL-W-20553D wax. Solid particles of other explosives such as cyclo-1,3,5-trimethylene-2,4,6-trinitramine (RDX), cyclotetramethylene tetranitramine (HMX) and 3-nitro-1,2,4-triazol-5-one (NTO) and aluminum powder are very often dispersed into the molten trinitrotoluene to the extent of about 40 to 70 weight percent of the total mix. Composition D-2 containing the wax and emulsifiers, varies from about 1 to 10 weight percent of the total mix. The emulsifiers serve a dual function, acting as a dispersant to uniformly disperse the solid particles, at the same time emulsifying the molten wax into the molten trinitrotoluene. These emulsion systems are anhydrous, and this invention does not relate to aqueous emulsion systems of explosives.

In another process, a larger amount of the desensitizing wax is used so it acts as the liquid vehicle for the solid particles at a temperature above the melting point of the wax but below the trinitrotoluene melting point. This is cast loaded into the munition case.

In another process, explosive particles, particularly RDX and HMX, are coated with desensitizing wax and press cast.

Recently the military has had a large continuing program to develop more insensitive high explosives. Serious problems have been encountered with the nitrocellulose emulsifier in the composition D-2 desensitizer used in the trinitrotoluene melt cast system. The nitrocellulose has settled to the bottom of some composition D-2 containers so that the nitrocellulose content of the charge to the mix kettles has been erratically variable. The nitrocellulose also coats out as a hard, difficult to remove layer on the sidewalls of the kettle. Emulsification of the wax is deficient, resulting in defective castings. An undesirable gassing problem has proven to be caused by reaction of the trinitrotoluene with the nitrocellulose.

Much effort has been directed towards finding a new better emulsifier system, without success.

Petroleum oil, SAE 10 engine oil, MIL-0-2104, and Gulf Crown E oil have been found to be successful desensitizer replacements for desensitizing wax in Composition B and with RDX.

An object of the present invention is to provide novel trinitrotoluene/desensitizer melt emulsion castings which are superior to the heretofore available emulsion castings containing nitrocellulose which resulted in defective cast explosives due to nitrocellulose separating and reacting with trinitrotoluene to form gas. These emulsions and castings may also contain other dispersed particles of high explosives such as cyclo-1,3,5-trimethylene-2,4,6-trinitroamine, cyclotetramethylene tetramitramine and/or 3-nitro-1,2,4-triazol-5-one (NTO) and/or aluminum powder. These explosive materials may be used in military or industrial explosive or pyrotechnic applications. Another object of the present invention is to provide emulsifying and dispersing agents consisting of suitable amines, amides, organic salts or polyfunctional organic and derivative compounds, having usefulness in the easier, more reliable preparation of trinitrotoluene/desensitizer melt emulsion castings of better quality, including safety. Another object of this invention is to provide the above in the case where the desensitizer is a wax or wax-like material or a petroleum oil. These and other objects and benefits of the present invention will become more readily apparent from a reading of the following detailed description.

It has now been found that trinitrotoluene/desensitizer melt emulsion castings can be prepared without the use of any deleterious nitrocellulose emulsifier, which was always required before, by using certain emulsifiers as provided in accordance with the present invention.

BRIEF DESCRIPTION OF THE INVENTION

In practice of the present invention, an emulsion is formed comprised of a nitrated energetic material such as trinitrotoluene, a desensitizer such as a wax or petroleum oil, and an alkylated polyvinylpyrrdidone emulsifying agent, and the resulting emulsion is melt cast to form an improved explosive, propellant or pyrotechnic product.

DETAILED DESCRIPTION

In accordance with the present invention, it has been found that a certain class of emulsifying agents is effective for the formation of stable emulsions comprised of nitrated energetic materials such as trinitrotoluene and a desensitizing agent such as wax, and the melt casting of such emulsions.

The emulsifying agents which are employed are alkylated polyvinyl pyrrolidines derived from vinyl pyrrolidone and long-chain alpha olefins. Structurally, these agents can be represented as:

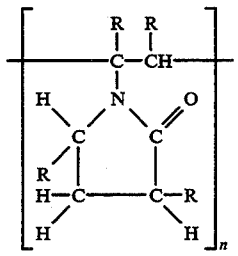

with R representing either an alkyl group containing about 12 to 40 carbon atoms, or a hydrogen. The alkyl groups containing about 16–40 carbon atoms are preferred and particularly preferred are those containing 16–30 carbon atoms. The polymers are prepared by copolymerizing an alpha olefin of the desired number of carbon atoms with vinyl pyrrolidone to a molecular weight of about 2,000 to 12,000 with about 3,000 to 10,000 molecular weight preferred. The weight nitrogen should be about 1.0 to 4.5 with about 1.5 to 4.0 preferred. Polymeric emulsifying agents of this type are available commercially, including products with 16, 20 or 30 carbon atom alkyl groups. They are manufactured and sold by International Specialty Products, Inc., under the tradename Ganex® V-216, Ganex® V-220 and Ganex® WP-660, respectively.

| | % Nitrogen | Molecular Weight |
|---|---|---|
| Ganex® V-216 | 2.5 | 7,000 to 8,000 |
| Ganex® V-220 | 3.1 | 8,000 to 10,000 |
| Ganex® WP-660 | 2.3 | 3,000 to 4,000 |

These products may be used individually as the emulsifying and dispersing agent in the practice of this invention or blended in any proportion to obtain the desired result. They may also be blended with other emulsifying and dispersing agents. This permits flexibility in matching compatibility with waxes of different composition or other chemical types of desensitizers to optimize effectiveness for different situations. These products can be modified chemically to further adjust for other components, or emulsifiers, dispersants, thickeners, coupling agents or stabilizers can be added to achieve complementary objectives.

The major function of the emulsifying agent in the practice of this invention is to emulsify a liquid desensitizing compound into a liquid energetic nitrated material, typically molten trinitrotoluene, which is cast to form a dispersion of solid desensitizer particles in solidified energetic nitrated material. Both the nitrated energetic material and the desensitizers must be liquid at 90° C. and the nitrated energetic material must solidify upon cooling, e.g. to 20° C. In many cases solid aluminum and explosive powders are dispersed into the molten trinitrotoluene at the same time, with the emulsifying agent serving a dual role as dispersing agent. Some desensitizers such as calcium stearate are dispersed as powders into trinitrotoluene because their melting point is too high. In this case, the emulsifying and dispersing agent used in the practice of this invention disperses rather than emulsifies the admixture. All emulsifying agents claimed in this invention are good dispersants and act as dispersants when solid particles are present to be dispersed. They are called emulsifying agents in the claims because this is their major and most critical function.

In formulating melt cast explosive systems or solid rocket propellants in the practice of this invention it is often advantageous to improve compatibility by adding a coupling agent or plasticizer, to reduce the viscosity with a plasticizer or dispersing agent, or reduce the melting or softening point of a thermoplastic explosive or desensitizer with a plasticizer or coupling agent, or to add an energetic plasticizer for enhanced energy. These auxiliary components are included in the compositions of the invention.

In practice, heretofore, the nitrocellulose and lecithin emulsifiers were dispersed in wax as a separate operation. MIL-C-18164A(OS), the wax classified as an explosive and stored until shipped to the user where it was stored again. This was expensive and with risk of accident. The emulsifying and dispersing agents of this invention can be dispersed in the wax or other desensitizing material, but are not explosive or dangerous. They can also be added separately to the mixing kettle, which is easiest, and cheapest with the least processing complications. This is the preferred procedure for the present invention.

After twenty to forty years of research, a suitable replacement for nitrocellulose and lecithin as emulsifiers for desensitizers such as natural wax, petroleum microcrystalline wax, polyethylene wax and petroleum process or motor oil in molten trinitrotoluene emulsions cast into a case for use as an explosive or pyrotechnic, had not been found in spite of deficiencies with the nitrocellulose/lecithin emulsifier system. Surprisingly, it has now been found that the alkylated polyvinylpyrrolidones emulsify and disperse remarkably well in the practice of this invention without the problems associated with past practice using nitrocellulose/lecithin as the emulsifying and dispensing agents. In the practice of this invention, other liquid energetic nitrated materials can be used in place of, or in combination with molten trinitrotoluene, including nitroethane, a liquid at room temperature, or a molten nitrate ester. Although petroleum microcrystalline paraffin wax, predominantly a linear alkyl hydrocarbon with some variable branching, is the most common desensitizing agent used for the trinitrotoluene melt emulsion case system, in the practice of this invention other wax or wax-like compounds or organic compounds or organic polymers or petroleum oil may be used. These have a different chemical composition. The natural waxes such as beeswax, carnauba wax and Montan wax are predominantly fatty acid esters, not hydrocarbons, polyethylene wax is an alkyl hydrocarbon, some with more or less branching than microcrystalline wax, and a petroleum process or motor oil is a liquid hydrocarbon at room temperature containing 10 to 40 weight percent aromatic hydrocarbons. The same chemical types of emulsifying and dispersing agents work for the explosives of different chemical composition and the desensitizers of different chemical composition. The polarity, or hydrophilic/-lipophilic balance of the emulsifying and dispersing agent can be adjusted to optimize performance for a specific case.

With a novel basic invention such as this, it is particularly valuable that the emulsifying and dispersing agents have the versatility to be utilized efficiently in various alternative applications rather than useful in only a single narrow area of the broad field. This is particularly true today, with a new emphasis on new and different explosive compounds and blends and different desensitizers, and different processing procedures such as thermoplastic continuous screw extrusion.

After years of evaluation, the U.S. government set up a standard emulsifying agent for emulsifying molten wax into molten trinitrotoluene for melt cast explosives. This emulsifying and dispersing agent was specified to be dispersed into a 175° F. to 200° F. melting point wax, typically a microcrystalline paraffin petroleum wax of low oil content. The composition of this MIL-C-18164A(OS), Composition D-2 is:

| | |
|---|---|
| Wax, MIL-W-20553D, Desensitizing | 84 ± 3 wt. % |
| Nitrocellulose, MIL-N-244 | 14 ± 1 wt. % |
| Lecithin, MIL-L-3061 | 2 ± 0.5 wt. % |

This specification describes a "Dispersion" (Emulsion) test to evaluate the acceptability of the emulsifying and dispersing agent for emulsifying that wax into molten trinitrotoluene to desensitize the explosive in a melt cast or other explosive process, paragraph 4.4.5.

To avoid the hazard of trinitrotoluene, nitroethane which has essentially the same weight percent $NO_2$, was substituted for trinitrotoluene in the evaluations according to the invention. Because of the volatility of the nitroethane, a screw-capped 40 milliliter vial, about 1 by 4 inches, was substituted for the open test tube with a wire mixer specified in the above specification. The experimental emulsifiers were evaluated in place of the nitrocellulose at 14 weight percent of the wax plus emulsifiers. Lecithin was used as a co-emulsifier unless otherwise noted at 4 weight percent based on the wax plus emulsifiers. In commercial practice, trinitrotoluene is charged to a steam heated kettle with composition D-2 and both are heated to about 88° to 95° C. and mixed until melted. Other fillers such as powdered aluminum, or explosive powders such as RDX, HMX or NTO are added and mixed to disperse, and then melt cast and cooled. To evaluate the emulsifiers, no fillers were used and the following are added to the 40 milliliter vial:

0.98 grams of experimental emulsifier #1

0.26 grams of lecithin Centrol 1P-UB, Central Soya Co.

5.74 grams of Indramic 170C, MIL-W-20553D

Desensitizing Wax 200° F. melting point microcrystalline

Paraffin Petroleum Wax sold by Industrial Raw Materials Co.

21.00 grams of nitroethane

The vial with tight screw-cap was heated in an oven at 90°-95° C. for about 1½ hours until all the wax had melted. It was then shaken vigorously vertically ten times to emulsify the wax into the nitroethane. The time before the first small amount of clear nitroethane layer separated out was recorded. According to the specification, this should be at least 5 minutes. Ineffective emulsifiers show separation in 1 to 10 seconds.

Results from this procedure have been demonstrated to correlate very well with results using trinitrotoluene evaluated by the exact specification method. Emulsifying and dispersing agents that produced emulsions of Indramic 170C wax with nitroethane which were stable for at least 5 minutes produced stable emulsions with all microcrystalline waxes evaluated in trinitrotoluene. Good emulsifying agents, selected from the alkylated vinylpyrrolidone products Ganex® V216, V220, WP660 or blends thereof, were evaluated in a different laboratory at both 5/1 and 3/1 weight ratio of trinitrotoluene to microcrystalline wax with equal success. They were also evaluated with 10 to 40 weight percent of aluminum powder and/or explosive fillers such as RDX, HMX or NTO with about 10 weight percent wax and about 25 to 70 weight percent trinitrotoluene. Emulsion and dispersion effectiveness and stability were excellent, good melt castings were obtained, the emulsifying and dispersing agents did not separate out as nitrocellulose did, and did not react with trinitrotoluene to produce gassing. Scale up to 20 and 50 pound kettle mixes and castings in anticipation of productions were successful, and the emulsified wax was an effective desensitizer. No unforeseen problems were encountered in mixing, casting or storage stability.

These results demonstrate the validity of using the above laboratory emulsion/dispersion test, with nitroethane replacing trinitrotoluene, to identify emulsifying and dispersing agents useful in the practice of this invention.

The preferable concentration for the emulsifying and dispersing agents is 0.05 to 3.0 parts per 100 parts by weight of energetic nitrated material, preferably 0.1 to 1.5 parts per 100 parts by weight of energetic nitrated material. The wax or other desensitizers are typically used at concentrations of 1 to 20 parts per 100 parts by weight of energetic nitrated material, preferably 1 to 10 parts per 100 parts by weight of energetic nitrated material.

The following examples illustrate specific embodiments of this invention. Unless otherwise indicated, parts, percentages and ratios are on a weight basis.

EXAMPLES 1-7

To determine the effectiveness of commercial Ganex® alkylated (C16, C20, C30) vinylpyrolidones as emulsifying and dispersing agents, 0.98 grams of individual Ganex® V-216, V-220 or WP 660 or blends of these were added to 5.74 grams of Indramic 170C wax and 21.0 grams of nitroethane in a 40 milliliter vial, with no lecithin (Table I, #1-4) and tested as above described. All were good for the practice of this invention having an emulsion stability of 8 to 18 minutes at 90°-95° C.

TABLE I

| EXAMPLE | EMULSIFIER #1 | #1 GRAMS | LECITHIN* Grams | EMULSION STABILITY Minutes |
|---|---|---|---|---|
| 1 | Ganex ® V-216 | 0.98 | 0 | 8 |
| 2 | Ganex ® WP-660 | 0.98 | 0 | 18 |
| 3 | Ganex ® 1/1 V-216/WP660 | 0.98 | 0 | 14 |
| 4 | Ganex ® 1/1/1 V-216/ V-220/WP-660 | 0.98 | 0 | 25 |
| 5 | Ganex ® 1/1/1 V-216/ V-220/WP-660 | 0.98 | 0.28 | 25 |
| 6 | Ganex ® 1/1/1 V-216/ V-220/WP-660 | 0.50 | 0.28 | 20 |
| 7 | Ganex ® 1/1/1 V-216/ V-220/WP-660 | 0.25 | 0.28 | 7 |

*Centrol 1P-UB, Central Soya Company

Adding 0.28 grams of lecithin to a tri Ganex ® blend did not have any effect on stability (Table I, #4–5). This tri Ganex ® blend at 75 percent lower concentration produced an emulsion stability of only 7 minutes, but this is still good (Table I, #7). With trinitrotoluene/microcrystalline wax melt casts using Ganex ® as the emulsifying agent, typically only 25–35 percent of the standard concentration was needed for most microcrystalline waxes and only about 10 percent for one of them.

COMPARATIVE EXAMPLES 8–14

A large number of other water insoluble emulsifiers were found to be ineffective in the same test used for Examples 1–7. A few are listed in Table II for illustration. 0.98 grams of each were used along with 0.28 grams of lecithin.

TABLE II

| EXAMPLE | EMULSIFIER #1, 0.98 GRAMS | EMULSION STABILITY Minutes |
|---|---|---|
| 8 | Aerosol TR070*, 70 wt. % in solvent sodium ditridecyl sulfosuccinate | <0.5 |
| 9 | Igepon T-77*, sodium N-methyl-N-oleoyltaurate | <0.5 |
| 10 | PBMA-8.9*, polybutadiene maleic anhydride adduct, 8.9 wt. % maleic anhydride, about 3,000 molecular weight | <0.5 |
| 11 | Solsperse 13345*, 45 wt. % amino polymerized fatty acid containing 5.7 wt. % nitrogen, 55 wt. % phthalate | <0.2 |
| 12 | Anti-Terra-204*, 50 wt. % higher molecular weight acid salt of polyamine amides containing about 1.8 wt. % nitrogen in solvents | <0.2 |
| 13 | Anti-Terra-V*, 50 wt. % higher molecular weight acidic ester salt of polyamine amides containing about 0.9 wt. % nitrogen in solvents | <0.2 |
| 14 | Silane A-1130, triamino functional trimethoxy silane | <0.2 |

*Sold by American Cyanamid Company, International Specialty Products Company, Mach I Inc., ICI Americans, Inc., Byk Cheme, Union Carbide Company.

EXAMPLES 15–18

Sodium ditridecylsulfosuccinate, Aerosol TR-70 and sodium N-methyl-N-oleoyltaurate Igepon T-77, blended 1/1 with Ganex ® WP-660 improved the emulsion stability effectiveness of Ganex ® WP-660 from about 5 to about 12 minutes (Table III, #15–17). Polybutadiene maleic anhydride adduct, PBMA-8.9 blended 1/1 with Ganex ® WP-660 reduced the emulsion stability to an unacceptable level (Table III, #18).

TABLE III

| NO LECITHIN | | |
|---|---|---|
| EXAMPLE | EMULSIFIER #1 | EMULSION STABILITY Minutes |
| 15 | Ganex ® WP-660 | 6.5, 4 |
| 16 | 1/1 Aerosol TR-70/Ganex ® WP-660 | 12, 15 |
| 17 | 1/1 Igepon T-77/Ganex ® WP-660 | 12, 11 |
| 18 | 1/1 PBMA-8.9/Ganex ® WP-660 | .05 |

The invention claimed is:

1. A composition useful for explosive, propellant or pyrotechnic melt casting comprising an energetic nitrated material which is liquid at 90° C., a desensitizer which is liquid at 90° C., and an effective amount of an alkylated polyvinylpyrrolidone emulsifying agent.

2. The composition of claim 1 wherein the energetic nitrated material is trinitrotoluene.

3. The composition of claim 1 wherein the alkylated polyvinyl pyrrolidone has a molecular weight of 2000 to 12000.

4. The composition of claim 1 wherein the alkylated polyvinyl pyrrolidone is derived from a $C_{16}$–$C_{40}$ alpha olefin and vinyl pyrrolidone.

5. The composition of claim 1 wherein the said composition contains aluminum powder.

6. The composition of claim 1 wherein the desensitizer is a wax or a petroleum oil.

7. The composition of claim 1 wherein the alkylated polyvinylpyrolidone is derived from a $C_{16}$ alpha olefin and vinyl pyrrolidone.

8. The composition of claim 1 wherein the alkylated polyvinylpyrolidone is derived from a $C_{20}$ alpha olefin and vinyl pyrrolidone.

9. The composition of claim 1 wherein the alkylated polyvinylpyrolidone is derived from a $C_{30}$ alpha olefin and vinyl pyrrolidone.

10. The composition of claim 1 comprising 0.05 to 3.0 parts by weight of emulsifying agent and 1 to 20 parts by weight of desensitizer per 100 parts by weight of nitrated energetic material.

11. The method of preparing a melt cast explosive, propellant or pyrotechnic which comprises forming an emulsion of liquid nitrated energetic material, liquid desensitizer and an alkylated polyvinylpyrrolidone emulsifying agent casting said emulsion into a suitable casing and solidifying the said emulsion.

* * * * *